US005555707A

United States Patent [19]

Schwenger

[11] Patent Number: 5,555,707

[45] Date of Patent: Sep. 17, 1996

[54] BLISTER PACK SCANNER DEVICE

[76] Inventor: Hans O. Schwenger, 730 Vail Rd., Parsippany, N.J. 07054

[21] Appl. No.: 198,728

[22] Filed: Feb. 18, 1994

[51] Int. Cl.[6] ..... B65B 57/08; B65B 57/18

[52] U.S. Cl. ..... 53/493; 53/495; 53/507

[58] Field of Search ..... 53/53, 54, 52, 53/493, 495, 494, 507, 508; 209/936, 643

[56] References Cited

U.S. PATENT DOCUMENTS

| | | | |
|---|---|---|---|
| 4,094,129 | 6/1978 | List | 53/54 |
| 4,307,555 | 12/1981 | Mlodozeniec | 53/53 |
| 4,472,922 | 9/1984 | Romagnoli | 53/53 |
| 5,033,251 | 7/1991 | Rodriguez | 53/54 |
| 5,040,353 | 8/1991 | Evans et al. | 53/54 |

FOREIGN PATENT DOCUMENTS

| | | | |
|---|---|---|---|
| 1202326 | 8/1970 | United Kingdom | 53/53 |

*Primary Examiner*—James F. Coan

*Attorney, Agent, or Firm*—Robert S. Honor; Melvyn M. Kassenoff; John L. Chiatalas

[57] ABSTRACT

A blister pack scanning device for detection and removal of overfilled or defective pharmaceutical blister packs is comprised of a photoelectric LED transmitter and sensor with a scanning beam channel bar disposed therebetween. The blister pack web is passed below the bar through a space precisely equivalent to the thickness of a properly filled blister. Overfilled or improperly molded blisters will contact a beveled edge of the bar as the web passes thereunder and the lateral movement forces the bar and its two end plates which are in juxtaposition to the transmitter and receiver respectively, to move upward, thereby interfering with the beams transmission. The interference created thereby shuts off the blister production machine and sounds an alarm for removal of the defective package.

9 Claims, 5 Drawing Sheets

BLISTER PACK SCANNER DEVICE

BACKGROUND OF THE INVENTION

The present invention relates generally to the packaging and preservation of tablets and tablet shaped medicinal dosage forms in the pharmaceutical industry. More specifically, the present invention relates to the packaging of tablets and tablet shaped compositions that contain active medicinal or nutritional agents that are compartmentalized in a prescribed dosage form. More specifically, the present invention relates to means for the large scale production of said tablet packaging and for the detection of aberrations in such packaging.

Blister packs have been well known as a means for the packaging of, in particular, pharmaceutical or nutritional tablets in a way that serves several purposes. Perhaps most importantly, they are tamper resistant in that the dosage form is contained within a plastic polymer cavity formed within a sheet of materials selected from the group comprising polyvinyl chloride (PVC), polyethylene, polypropylene, polystyrene, etc. and mixtures thereof. Preferably, polyvinyl chloride is the polymer used to make the sheet or web which is molded with tablet-sized cavities and covered with an aluminum or other suitable foil sheet. Any attempt at tampering with the tablet itself would require rupturing either the foil or PVC seals and this, for the most part is readily apparent to the naked eye. Any such damage to the blister pack would alert the patient or consumer that some invasion has occurred and that perhaps taking the tablet may be ill advised.

Blister packs also serve to provide a means to package the medication or nutritional dosage form so that it is available in the specific dosage required and there is no guesswork as to how many tablets should be taken. Each tablet is individually or dually contained within the package cavity and may be only obtained by forcefully pressing against the PVC bubble and pushing it out through the laminated foil cavity cover. Such packs also protect the tablet from moisture and air degradation as the tablet is hermetically and vacuum sealed within the package and protected thereby until opened.

The concept of blister pack technology is well known in the art and has in fact been a standard of the pharmaceutical industry, both $R_x$ and OTC, for many years. The size of the PVC blister or cavity may be formed according to the size of the tablet that is to be contained therein. The number of blisters or cavities per pack is also dependent on tablet size and dimensional considerations such as what constitutes a convenient package size. Generally, the size of the blister cavity is standard according to the tablet to be packaged as is the number of cavities and size of the PVC package sheet in which they are contained.

Blister pack production machines are commercially available from Bosch GmbH, Waiblingen, Germany and essentially carry out the following process. A rolled web of PVC plastic supplies the blister material as the sheet is pulled by an Idler unwinding unit that is fed to a heating station via deviating rollers where the film is plasticized by contact heaters. The contact heaters can be adjusted for precise plasticization of the PVC film by controlling the temperature, contact pressure, and heating time. By directly monitoring energy consumption, only the film is heated and not the surrounding machine or environment. Once the critical plasticization temperature is reached, the PVC film web is fed along the conveyor rollers into the forming station.

The web is then thermoformed in a pressurized diaphragm station where the edges of the web are gripped and pulled taunt. Compressed air is then injected at critical points along the web which correspond to the respective cavity placement sites. The cavities are formed as the PVC web sheet is drawn into the cavity molds of the thermoforming chambers by means of the compressed air. Precisely engineered molds create blister cavities that are uniform in size and thickness.

The multi-blistered web is then transferred to the filling station where the tablet to be packaged can either be manually deposited within each cavity or as is more often the case, automatically placed therein using automated feeder tubes. The filled yet open blister packs continue onward to a foil sealing station wherein the lidding foil is fed into the machine and sealed onto the thermoformed web. A sealing roller with bores corresponding to the cavities of the web indexes and transports the PVC blister web through the sealing station at which point the heating roller fuses the lidding foil to the PVC web thereby sealing the cavities closed.

The filled and sealed web is embossed, perforated and then cut to the appropriate sized package so that unit doses can be removed from the main package without having to remove the tablet from the package until it is ready to be taken. Pressure is exerted against the PVC blister cavity and the tablet is pushed through the foil cover.

The movement of the PVC web through the cavity forming,heating and sealing stations is intermittent. Movement of the web through the filling station however, is continuous and therefore there is a chance that the tablets can either be improperly disposed within the cavity or more than one may be placed therein. Such aberrations are unacceptable in large scale commercial operations and there is therefore a need to detect when improperly filled packages occur.

The use of electronic sensors as a means of detecting errors or problems in large scale conveyor belt production has been used with limited success. U.S. Pat. No. 4,593,515 discloses the use of an electronic sensor which is positioned under the conveyor belt of a wrapping machine. Articles dropped from the conveyor path fall upon the sensor which not only catches the articles but generates a stop signal which stops the conveyor belt so the article may be retrieved and placed back on the belt.

U.S. Pat. No. 5,040,353 to Evans et. al. discloses a blister packing process whereby a sensor apparatus includes a plurality of air valves for removing empty blister cavities prior to sealing. The cavities pass through a detection station which sends a signal to the pneumatic air valves upon sensing an empty blister packet. This ignites a high pressure air flow which selectively separates the unfilled, empty blister cavities from the filled packs which are ready for sealing.

U.S. Pat. No. 4,472,922 to Romagnoli teaches a system for monitoring a blister packaging machine comprising a photosensitive detector device which scans the blister pack carrier strip and upon sensing an empty blister cavity activates a perforator that punches a hole into the cover strip comprising the empty blisters. An error pulse simultaneously loaded into a shift register actuates, after a suitable delay, a sorter downstream of the cutting station that eliminates the defective blister package from the regular machine output.

None of the aforementioned devices however, utilize a laser sensitive photoelectric device which has the ability to detect overfilled and defective PVC blister cavities so as to permit the shut down of the system for the blister pack pickup and removal. Nor has there been any prior art device that may be adjusted for different sized blister cavities while not requiring any movement of the photoelectric laser equipment which might otherwise result in misaligning the beam.

SUMMARY OF THE INVENTION

The present invention is a scanner means for detecting improperly molded or filled blister packs containing medicinal or nutritional tablets. Using a laser beam photoelectric sensor, the device utilizes a scanner beam channel bar which is specifically designed according to the size of the blister cavity to be scanned. Whereas properly filled cavities present a precisely defined height, any deviation therefrom that is the result of an improperly filled cavity will strike the bar as the web moves through forcing it upward. Plates secured at the ends of the bar intersect and block the beam which automatically stops the production unit thereby cutting off movement of the web so that the defect can be corrected. Since the scanner bars are interchangeable, different sized blister packs can be scanned without requiring re-alignment of the beam.

DETAILED DESCRIPTION OF THE INVENTION

LED photoelectric sensor beams have been used widely for detecting improperly positioned articles moving along conveyor belts of large scale production operations but they have never been utilized in the blister packaging industry. The laser beam emitted from the LED of the light source is made parallel by a lens. It then passes through a slit in the receiver and is conveyed by a second lens where a sensor records the degree of light received. When an object passes though the parallel beam between the light source and receiver, a change in the quality of light passing thereto occurs. This change is compared with a reference value in the sensor which send a signal that operates one of a number of functions depending on the application. In the present instance, the single turns off the scanner and movement of the blister pack and production apparatus if deviated therefrom.

The LED beam cannot detect very slight imperfections in PVC blister cavities by itself however. The dimensions of polymer plastic blister cavities will vary according to the size of the tablet to be packaged. The thickness of, for example, a PVC film comprising the cavity and web may vary slightly but is generally about mil. Also, the beam cannot register consistently in this application since the blister pack web is fed through the production machine in a blister down, foil side up position as will be more fully described later. As it comes out of the foil sealing unit, the web is hot and will tend to buckle or bend. This formation would interfere with the beam constantly if something more was not done. Moreover, the beam by itself could not detect imperfections on the foil side alone. In order to enable the precise detection of the slight blister deviations, a trigger mechanism comprising an aluminum scanner bar is positioned below and parallel to the beam providing a passageway for the blister packs to pass under. This bar not only flattens and holds down buckled or wavy portions of the PVC web in an even planar surface but it will also allow for detection of blister overloads and imperfections from the foil side as well.

Figure 1:
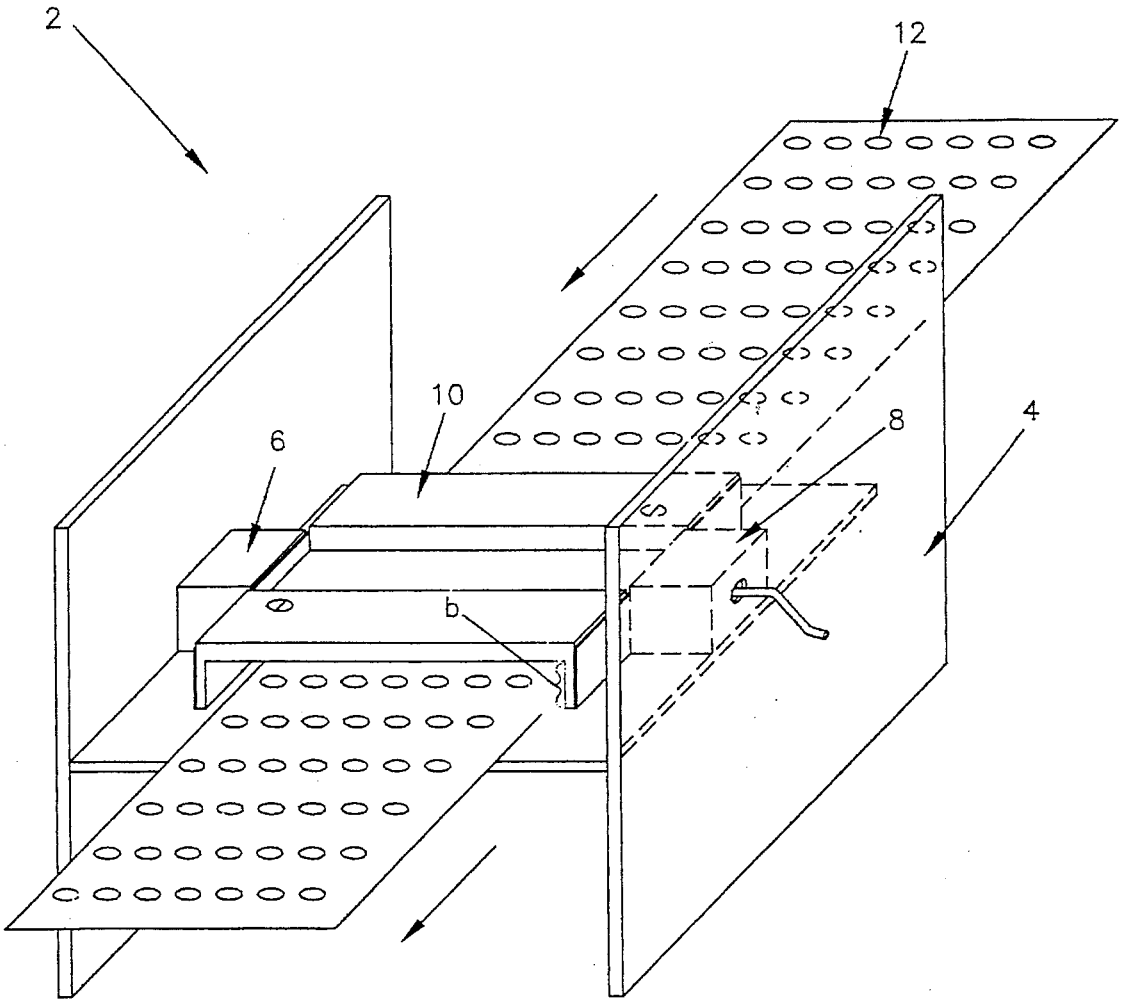
FIG. 1 is an overall view of the scanner showing a formed and filled PVC blister web as it moves through the scanner.

Each scanner bar is tailored to the specific size and height of the blister cavities that comprise that packaging being scanned. Generally the size and height of all blister cavities molded into a plastic web are identical. Referring to FIG. 1, the scanning device (2) is shown in toto with the blister pack production unit in operation and a typical blister pack plastic web passing through. The device (2) which would be positioned downstream and adjacent to the foil sealing unit is comprised of a housing support or base (4) which holds and aligns the laser beam transmitter (6) and sensor (8). Disposed therebetween is the bridge-like scanner bar (10) through which the sealed tablets (2) of a blister pack pass. The bar (10) is constructed according to the precise specification of the blister pack to be scanned so that the width (a) will substantially equal the width of the PVC web while the height (b) of the passageway will precisely equal the height of the properly filled and sealed blister cavity. The bar (10) is aligned precisely between the transmitter (6) and sensor (8)

Figure 2:
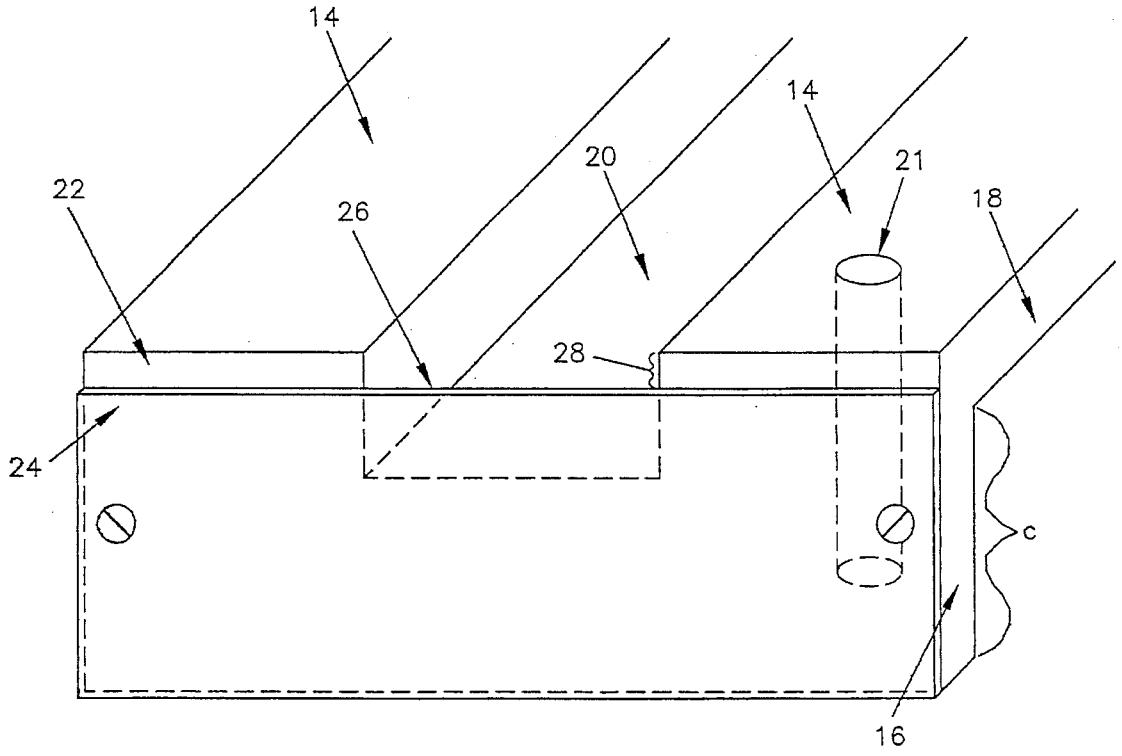
FIG. 2 is an isolated view of the scanner bar separate and apart from the laser detection apparatus.

Referring now to FIG. 2, the scanner bar (10) is essentially a bridge-like assembly, preferably comprised of aluminum and consisting of a top (14), two post-like ends (16) and two sides (18). The height (c) of the posts (16) corresponds precisely with the height (or depth depending upon one's orientation) of the blister pack cavities. A substantially rectangular groove (20) is centrally cut within the top (14) and runs the length of the bar transverse to the direction of blister pack movement. It is within the groove (20) that the laser beam passes and is channeled from the laser transmitter (6) to the sensor (8) as shown in FIG. 1. As will be seen later, this groove (20) may be covered with a removable plate so that there is no interference with the beam other than by movement of the bar during use.

The bar is secured to the housing by means of a rod or pin (not shown) which is fitted within a bore (21) that runs the length of the post (16). By fitting over the rod in this manner, the bar has upward mobility so that it can float over the blister pack when a defective or overloaded blister contacts it as will be shown later. The bore also prevents any lateral movement of the scanner bar along the housing unit.

Both ends (22) of the scanner bar (10) have secured thereto aluminum plates (24) which substantially conform to the size and shape of the ends (22). The width of plates (24) is slightly smaller than that of the ends (22) so that when secured thereto, the top edge (26) of the plate (24) is not as high as that of the ends (22). This creates a gap (28) where the groove is located and this gap may range from 0.05 to 0.3 inches, preferably from about 0.5 to 0.15 inches, and most preferably will be about 0.1 inches. The discrepancy between the side of the plates and the height of the bar creates a small slit or passage whereby the volume defined by the channel (20) is longitudinally contiguous with the outside environment not defined by the dimensions of the bar (10).

Figure 5:
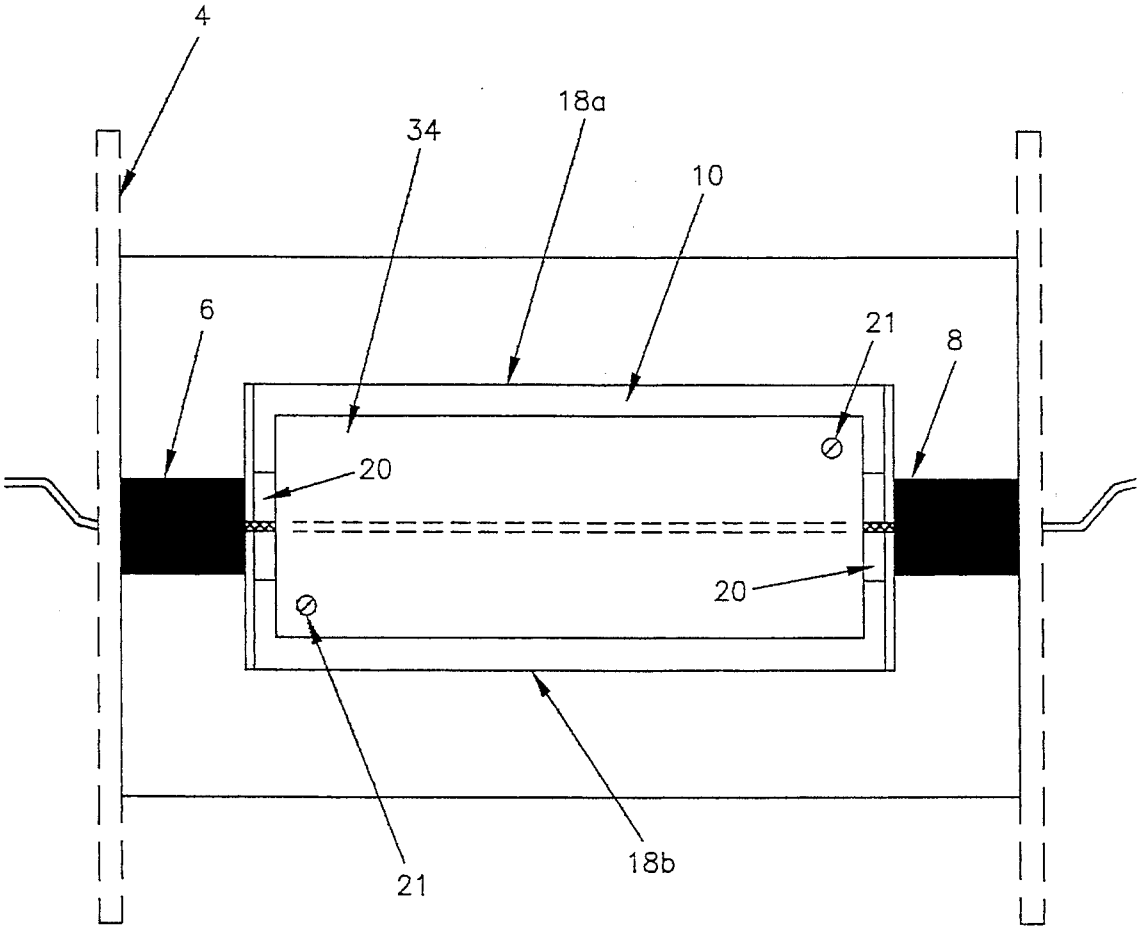
FIG. 5 is an overhead view of a second embodiment of the present invention wherein the channel groove is covered by a guard plate.

This passage or slit is so constructed that when the scanner bar (10) is properly positioned between the LED laser beam transmitter and the sensor, the plates (24) are in juxtaposition to the transmitter (6) and the sensor (8) and the beam itself passes through the slit whose bottom boundary is formed by the top edge (26) of the plate (24). An optional embodiment of the present invention utilizes a top cover plate (not shown) which lays over the top (14) and covers the groove (20). As seen in FIG. 5, a cover (34) is secured to the top (14) of the bar (10) and its plane defines the upper edge of the slit through which the LED beam passes.

Figure 3:
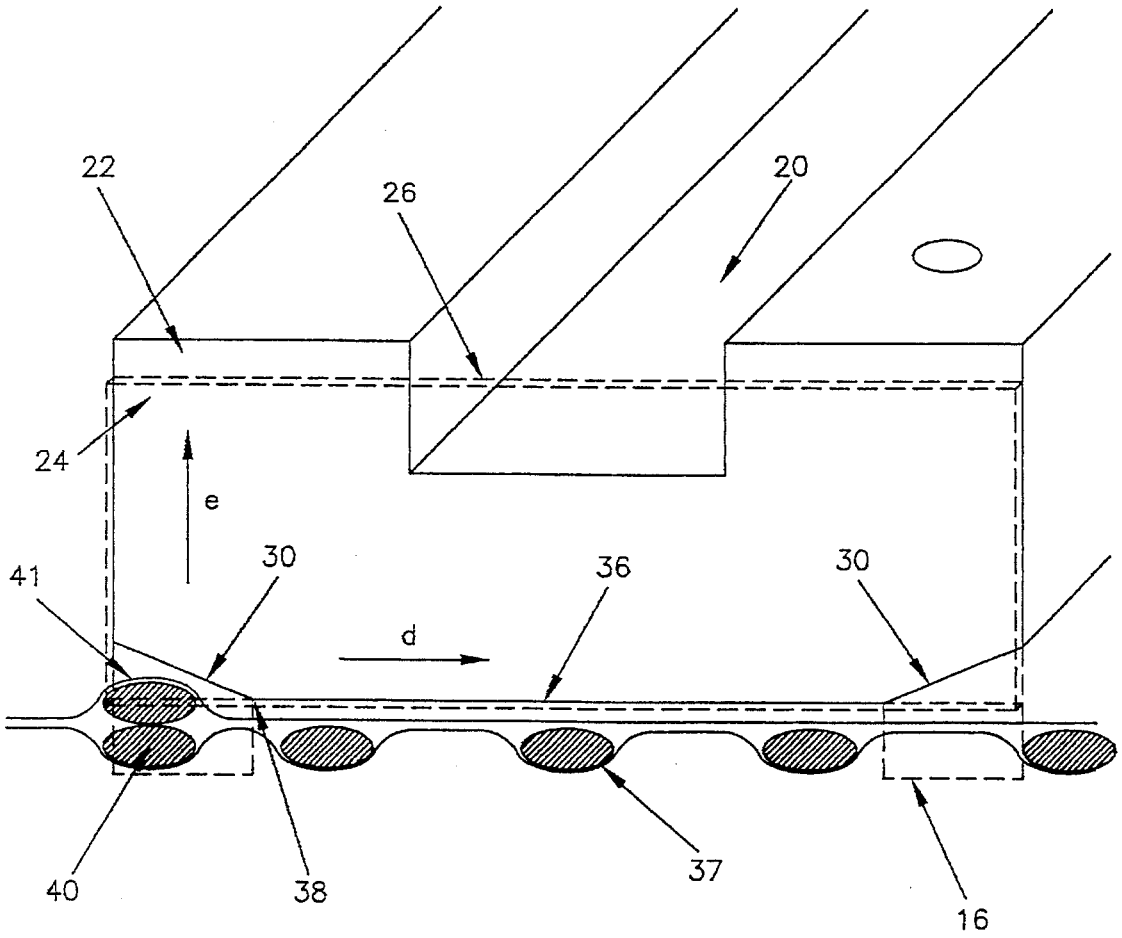
FIG. 3 is a cross-sectional view of the bar with the end plates removed.

Referring now to FIG. 3, an isolated partial view of the scanner bar (10) is shown from one end with the end posts (16) and plates (24) in phantom showing a beveled edge (30) of the bar (10) that intercepts overfilled defective blister cavities. A PVC web with its filled blister cavities will normally be aligned so that the foil seal (36) which is the upper most surface of a normal filled blister (37) will just pass under the lower edge (38) of the bar. Overfilled or defective blisters (40) will not freely pass under the bar and will strike the beveled edge (30) of the bar (10). As the blister pack continues its movement (d) along the production path, its movement on the misaligned foil surface (41) of blister pack (40) will force the bar (10) in an upward movement (e) which consequently results in the outer plates (shown in phantom, 24) intercepting and breaking the beam thereby stopping the blister packaging machine.

Figure 4:
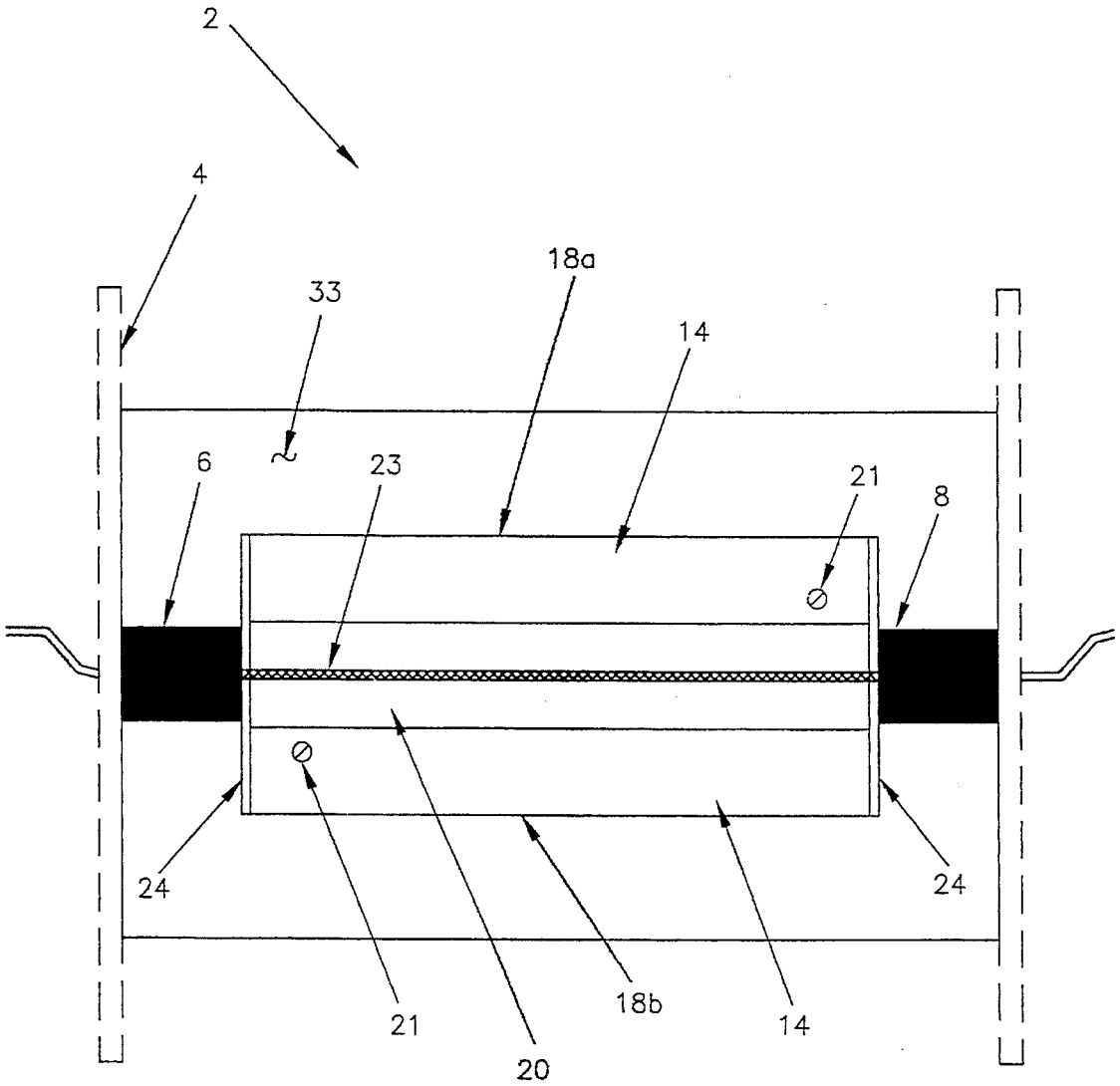
FIG. 4 is an overhead view of the scanner assembly and scanner channel bar.

Referring now to FIG. 4, an overhead view of the scanner device in toto (2) shows the complete invention in another perspective. The housing (4) secures the scanner plate (10) of the present invention between the LED laser beam transmitter (6) and the sensor (8) by rods extending upwards from the housing base plate (33) through the bore (21). The central groove (20) is shown with a laser beam (23) passing therethrough. The occurrence of any over filled or defective blister as shown in FIG. 3 will contact and press against the beveled edge and the webs lateral movement will force the bar (10) and end plates (24) upward thereby interrupting the beam (23) and stopping the machine. The blister pack to be scanned will pass under side edge (18*a*) and exit side edge (18*b*).

Referring now to FIG. 5, another optional embodiment of the present invention is comprised of the same scanner channel bar (10) sandwiched between the laser beam transmitter (6) and sensor (8). In this embodiment however, a top cover (34) is secured to the top (14) of the scanner bar (10) preferably at the bores (21) and rods contained therein, thereby fully enclosing the central groove shown in phantom (20) and providing an enclosed housing for the beam (23). The plate (34) can either partially cover the groove (20) as shown, or can substantially cover the entire top (14) and groove (20) in toto. This may prove particularly valuable in production facilities where external environmental factors such as dust, large airborne particles, light etc. may be present and interfere with the beam itself.

It is realized that many slight changes or variations might be made to the embodiments described herein so as to change the basic form of the present invention without radically changing its purpose or function. It is to be understood that any such modifications or changes are contemplated as falling within the spirit and scope of the present invention as recited by the claims that follow.

What I claim is:

1. A blister pack photoelectric laser sensor device for the detection of overfilled and defective blister cavities comprising:

a) a housing base;

b) a laser transmitter disposed at one end thereon;

c) a photoelectric sensor disposed opposite said transmitter for receiving a laser signal therefrom, and;

d) a scanner beam interference bar disposed between said transmitter and said sensor, said interference bar comprising a centrally grooved top surface for alignment of said laser beam, a bottom surface and two end posts that elevate the bottom surface of said bar slightly above the housing base to allow a plastic polymer blister pack web to pass therethrough.

2. The sensor device of claim 1 wherein said scanner bar further comprises two plates secured to said end posts that partially cover the ends of the centrally grooved top surface in said scanner bar and are proximate to the transmitter and receiver, respectively.

3. The sensor device of claim 2 wherein said bottom surface of said scanner bar has two beveled edges along its length under which properly filled blister cavities pass.

4. The sensor device of claim 3 wherein the end posts of said scanner bar guide the plastic polymer blister web through the scanner.

5. The sensor device of claim 4 wherein said beveled edge of said bottom surface of the scanner bar contacts overfilled and defective blister cavities thereby urging the scanner bar upwards so that the end plates intersect and interfere with transmission of the laser beam.

6. The sensor device of claim 5 wherein the interference of the laser beam actuates an alarm and turns off a blister packaging machine.

7. The sensor device of claim 6 wherein said scanner beam interference bar further comprises a cover plate secured to the top thereof that partially or totally covers the central groove of the top surface.

8. A means for detecting defective blister packs containing pharmaceutical dosage forms using the photoelectric sensor device of claim 7.

9. The means of claim 8 wherein said pharmaceutical dosage form is selected from the group consisting of coated and uncoated tablets, capsules, caplets, gel caps, lozenges and mixtures thereof.

* * * * *